US006860130B2

(12) United States Patent
Brantschem

(10) Patent No.: US 6,860,130 B2
(45) Date of Patent: Mar. 1, 2005

(54) EASY-TO-MANEUVER KEY-RING

(75) Inventor: Nicolas Brantschem, Lausanne (CH)

(73) Assignee: Lafina Management SA (CH)

( * ) Notice: Subject to any disclaimer, the term of this patent is extended or adjusted under 35 U.S.C. 154(b) by 0 days.

(21) Appl. No.: 10/476,241

(22) PCT Filed: May 26, 2003

(86) PCT No.: PCT/IB03/02004

§ 371 (c)(1),
(2), (4) Date: Oct. 28, 2003

(87) PCT Pub. No.: WO03/105620

PCT Pub. Date: Dec. 24, 2003

(65) Prior Publication Data

US 2004/0118174 A1 Jun. 24, 2004

(30) Foreign Application Priority Data

Jun. 18, 2002 (FR) ..... 02 07468

(51) Int. Cl.[7] ..... E05B 15/00
(52) U.S. Cl. ..... 70/456 R; 70/456 B
(58) Field of Search ..... 70/456 R, 457, 70/458, 459, 456 B; D3/207, 208, 210

(56) References Cited

U.S. PATENT DOCUMENTS 4,325,273 A * 4/1982 Gibbons ..... 81/485
4,543,860 A 10/1985 Van Meter ..... 81/488
D374,344 S * 10/1996 Sunderland et al. ..... D3/211
5,722,277 A * 3/1998 Williams ..... 70/456 R
D404,621 S * 1/1999 Liese ..... D8/16
6,092,405 A * 7/2000 Berwick ..... 70/408
6,681,608 B1 * 1/2004 Hope, III ..... 70/456 R

FOREIGN PATENT DOCUMENTS

GB 2 350 579 12/2000 ..... A44B/15/00

* cited by examiner

*Primary Examiner*—John B. Walsh
(74) *Attorney, Agent, or Firm*—Renner, Kenner, Greive, Bobay, Taylor & Weber

(57) ABSTRACT

A key ring comprising a preferably circular ring having a complete first turn 1 and a part of or preferably a complete second turn 2 joined to and resiliently pulled towards the first turn, which is separated from the second turn by a gap extending between the two turns and between the two free ends 3, 5 thereof, the head of a key being passed through the gap so as to fix it to or remove it from the key ring, wherein a lug 9 is provided in the form of a claw having a leading edge 10 sufficiently thin to be inserted into the gap and sufficiently wide, by rotating the lug, to move the two turns apart sufficiently to insert a key head between them, and fixating means for fixating the lug at a distance from the ring sufficient to allow the insertion of the lug into the gap.

9 Claims, 3 Drawing Sheets

EASY-TO-MANEUVER KEY-RING

The invention relates to a key ring comprising a preferably circular ring having a first complete turn and at least a part, preferably an entire, second turn joined to and resiliently pulled towards the first turn, the first turn and the part of the second turn being separated by a gap through which keys are passed in order to attach them to or detach them from the key ring.

This kind of key ring is well known in the art. The main advantage of this kind of key ring is that the keys are firmly attached to the ring and cannot accidentally come loose, inter alia as in the case with the prior-art key rings, which are opened and closed e.g. via a clip or catch and can accidentally open, e.g. after an impact, so that one or more keys drop out of the key ring.

However, the advantage of the key ring having two turns resiliently urged towards one another is offset by a disadvantage which does not apply to prior-art key rings opened and closed by a catch or clip, in that it is difficult to insert a key or remove it from the key ring since the second turn is resiliently urged against the first turn by a considerable force which has to be counteracted, e.g. with a fingernail, and it is not unusual to break a nail when trying to take a key from or put it on a two-turn key ring according to the preamble.

From U.S. Pat. No. 4,543,860, it is known also a key ring, comprising a ring, preferably circular, having a first complete turn and at least a part, preferably an entire, second turn, joined to the first turn and resiliently urged against the first turn, the first and second turns being separated by a gap extending itself between the two free ends of the two turns and between the two turns, gap through which is being passed the head of a key so as to fix it to or remove it from the key ring, in which a lug is provided which comprises a main body and a claw shaped part, having a leading edge sufficiently thin to be inserted into the gap and sufficiently wide, by rotating the lug, to move the two turns apart sufficiently to insert a key head between them and a chain for fixating the lug, at a distance from the ring, and this at a sufficient distance from the ring to allow the insertion of the lug into the gap. Furthermore, the claw shaped part is sufficiently wide so that said claw shaped part can stand on a upright position between the turns without that the user having to hold it with its fingers, so that he has both hands free to have the key head passing through said gap.

However the upright position of the claw shaped part between the two turns, approximatively perpendicular, is not very stable in those known key rings, so that on one part it is difficult to have the claw holding on itself between the turns and on another part it frequently happens that the claw leaves on itself its upright position, perpendicularly to the two turns, and the user has to move again the turn apart the one from the other and place the claw upright between them. The object of the invention is to provide a key ring as described above, which allows maintaining spread apart the one from the other the two turns without the help of the finger in a position of the turns in which they are spread apart in which the user has both hands free to introduce its keys in the ring, the position of the turns spread apart being on one part easier to obtain, compared to the anterior art, and on another part more stable than in the case of the known key ring.

The invention relates to a key ring comprising a preferably circular ring having a complete first turn and at least a second turn joined to and resiliently pulled towards the first turn, which is separated from the second turn by a gap extending between the two turns and between the two free ends thereof, the head of a key being passed through the gap so as to fix it to or remove it from the key ring, wherein a lug is provided in the form of a claw having a leading edge sufficiently thin to be inserted into the gap and sufficiently wide, by rotating the lug, to move the two turns apart sufficiently to insert a key head between them, characterized in that an auxiliary ring is provided to fixate the lug to the ring, said lug having an opening through which the auxiliary ring passes, the relative dimensions of the auxiliary ring, of the leading edge and of the opening of the lug being selected so that when the lug is turned of about 90°, with the leading edge inserted with its width into the gap between the two turns, the auxiliary ring is in contact with the lug, so that the rotation of the lug is no more possible in one direction of rotation, the lug being then maintained between the two rings so that a user can insert a key between the two turns without having to hold the lug.

By providing such an arrangement, one makes sure that when the lug is pivoted on 90° relative to the turn, it is in contact with the auxiliary ring so that it holds on itself in this position perpendicular to the ring plane, and this in a particularly stable manner, due to the maintaining or supporting action of the auxiliary ring on the lug with which it is in contact.

Preferably, the auxiliary ring is in contact with the lug on both sides of the lug.

In a preferred embodiment, the internal diameter of the auxiliary ring is essentially equal or greater to the sum of the useful width of the lug and of the two thicknesses of the two turns, in a direction perpendicular to the plane defined by the key ring.

According to an improvement of the invention, the lug which is thin and claw-shaped, has two parallel spaced-apart lateral edges, the distance between the two edges, which corresponds to the useful width, being such that when the lug is placed in the gap with the two lateral edges in contact with the two respective turns, the gap is sufficiently open to insert a key head.

Therefore, by providing the two lateral parallel edges, the lug can be rotated through 90° after inserting into the gap so as securely to hold the two turns apart by perpendicularly interposing the lug, which rests via its lateral edges against the two respective turns.

According to a particularly preferred embodiment of the invention, particularly simple to insert, the claw-shaped lug has a bevelled leading edge. The bevel is for particularly efficient insertion into the gap in order to separate the two turns.

In a particularly stable embodiment, the opening has a dimension in the direction parallel to the leading edge of the lug substantialy equal or greater, preferably equal to, to the sum of the useful width of the leading edge and of the two thicknesses of the two turns in a direction perpendicular to the ring plane.

In a preferred embodiment of the invention, the lug is of the same material as the ring or rings, inter alia steel.

In an embodiment which is particularly important for bringing a trademark to general notice, the component in the form of a lug comprises an enlarged key head bearing stuck or engraved information, inter alia trademarks or advertising designs or logos.

The drawings, given by way of example only, show a preferred embodiment of the invention.

Figure 2:
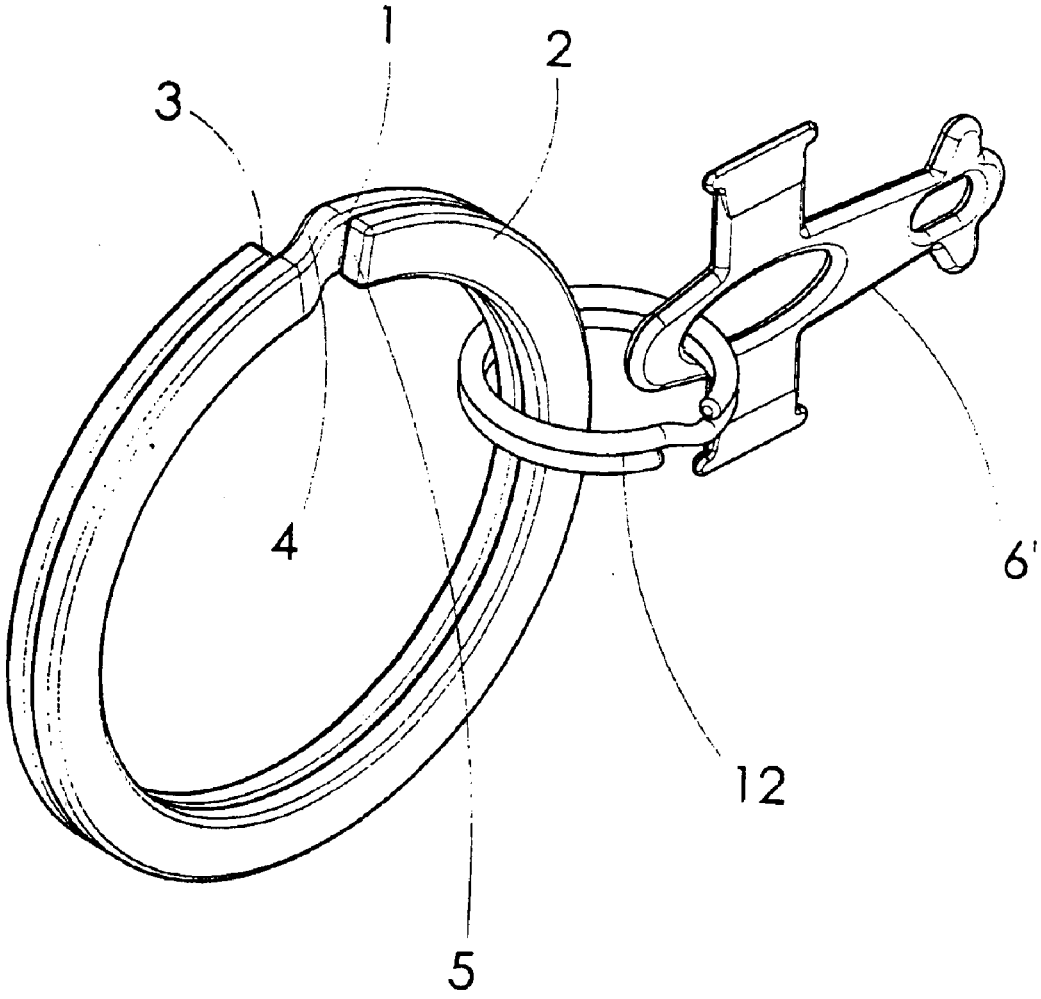
FIG. 2 is a perspective view of an embodiment of a key ring according to the invention, in the position where the ring is closed.

FIG. 2 shows a circular ring comprising a first turn 1 and a second turn 2. The first turn 1 extends from a first free end 3 to a part 4 separating the two turns, the part 4 being in the form of a half-bridge such that the ring continues via the second turn 2 beyond the first turn 1. The second turn 2 extends from the part 4 to a free end 5. The two turns are resiliently pulled against one another by the resilience of the metal of which the ring is made. In order to insert a key into the key ring, one free end has to be "opened" by separating the turns from one another. Once the two turns have been separated, the perforated head of a key can be inserted and slid along the gap between the two turns until it is brought inside the ring.

Figure 1:
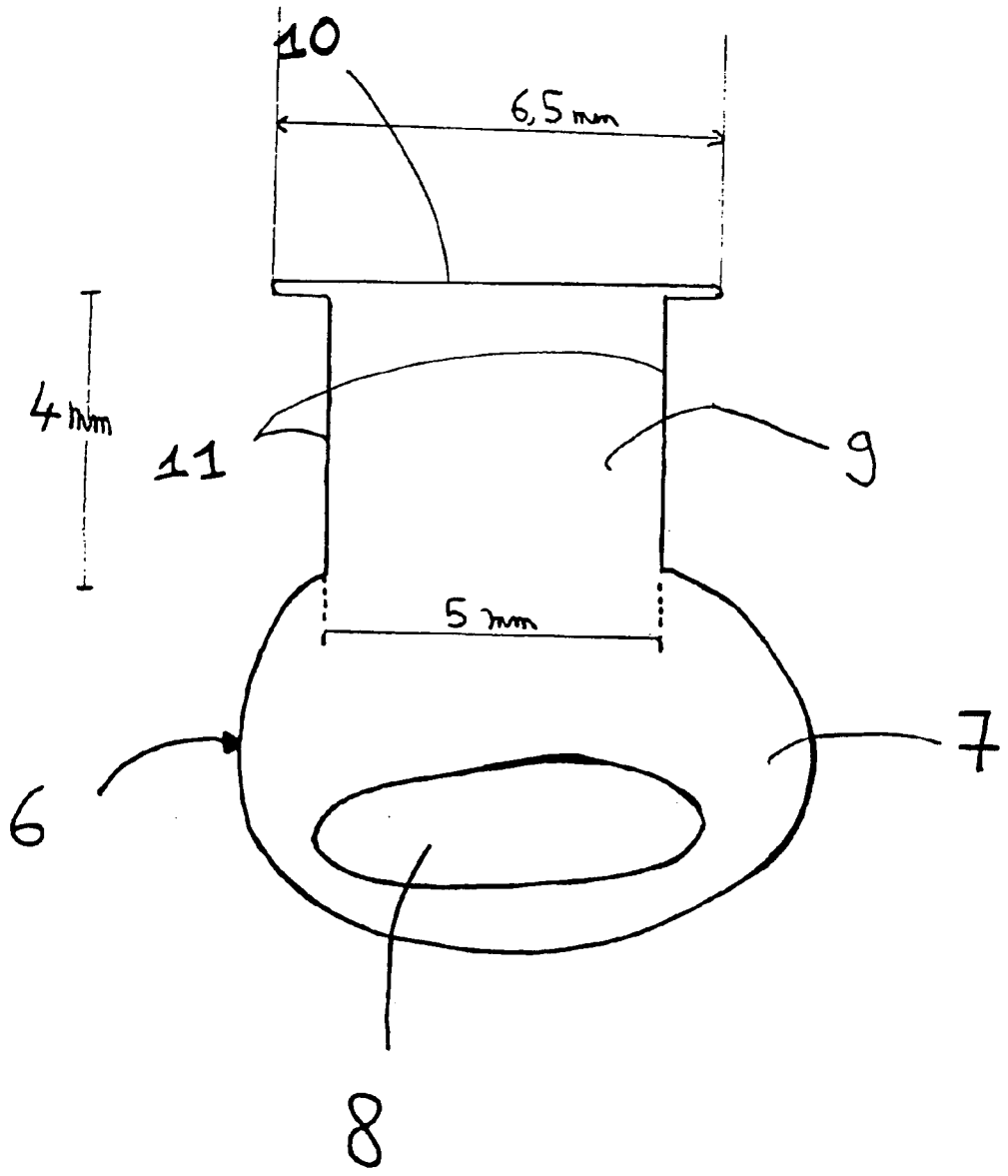
FIG. 1 shows a first embodiment of a lug-shaped component according to the invention.

FIG. 1 shows the component 6 comprising an enlarged head part 7 formed with an opening 8 and a part 9 in the form of a claw-shaped lug. The lug 9 is substantially rectangular, with a leading edge 10 and two parallel side support edges 11. The leading edge 10 is slightly bevelled.

Figure 3:
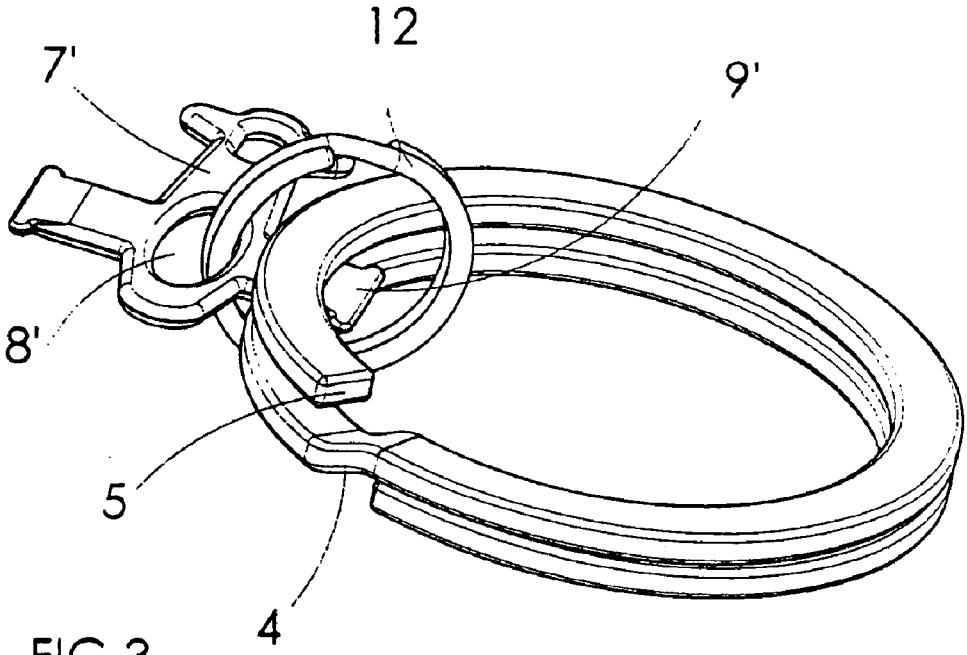
FIG. 3 is a perspective view of the key ring in FIG. 2, in an intermediate position in which a lug separates the two turns from one another.
Figure 4:
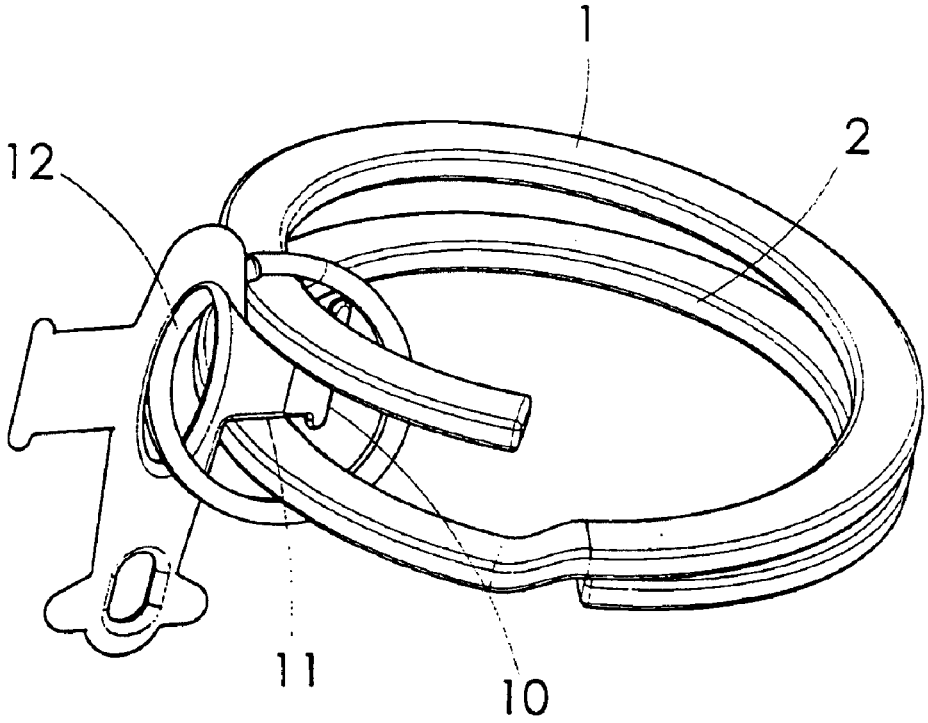
FIG. 4 is a perspective view of the key ring in FIGS. 2 and 3 in which the lug separates the two turns from one another in a position which is automatically retained.

FIGS. 2, 3 and 4 show another embodiment of the component 6, marked 6', comprising two claw-shaped parts 9'.

A small ring 12 secures the component 6 or 6' to the ring by engagement in an opening 8 or 8'. The dimensions of the ring 12 and the opening 8 or 8' are such that the lug can be at a sufficient distance from the ring to be handled, i.e. to be inserted into the gap between the two turns and then rotated through 90°, i.e. a quarter revolution, so as to be put in the "perpendicular" position as shown in FIG. 4, where the two turns automatically remain at a distance from one another so that a key head can be inserted between the two turns. The head 7, 7' of the lug-shaped component bears information or advertising logos or trademarks. The head, which is enlarged and flat, enables the lug to be easily handled so as to insert it between the two turns. Alternatively the shape may be other than flat.

In an embodiment given by way of example, the main ring has an outer diameter of 32 mm, a thickness of 3 mm in the direction perpendicular to the ring and a thickness of 3 mm in the direction parallel to the plane of the ring.

The auxiliary ring 12 has an outer diameter of 12 mm, a thickness of 2 mm in the direction perpendicular to the ring and a thickness of 1.5 mm in the direction parallel to the ring. The claw-shaped lug has a leading edge extending over 6.5 mm. The two side edges extend over 4 mm, a distance substantially equal to or slightly greater than the thickness (3 mm) in the direction parallel to the plane of the ring. The diameter of the small ring is substantially equal to the thickness of the two turns in the plane perpendicular to the ring plus the distance (5 mm) between the two holding side edges.

What is claimed is:

1. A key ring comprising a ring having a complete first turn and a second turn joined to and resiliently pulled towards the first turn, which is separated from the second turn by a gap extending between the two turns and between the two free ends thereof, the head of a key being passed through the gap so as to fix it to or remove it from the key ring, wherein a lug is provided with a leading edge sufficiently thin to be inserted into the gap and sufficiently wide, by rotating the lug, to move the two turns apart sufficiently to insert a key head between them, wherein an auxiliary ring is provided to fixate the lug to the ring, said lug having an opening through which passes said auxiliary ring, the relative dimensions of the auxiliary ring, of the leading edge and of the opening of the lug being selected so that, when the lug is rotated of substantially 90 degrees, with the leading edge inserted on its width in the gap, the auxiliary ring is in contact with the lug so that the rotation of the lug is not possible in one direction of rotation, the lug being then retained between the two turns so that a user can insert a key between the two turns without having to hold the lug, the internal diameter of the auxiliary ring being substantially equal or greater to the sum of the useful width of the lug and of the two thicknesses of the two turns, in a direction perpendicular to the plane defined by the key ring.

2. A key ring according to claim 1, wherein the auxiliary ring is in contact with the lug on both sides of the lug.

3. A key ring according to claim 1, wherein the lug which is thin and claw-shaped, and has two parallel spaced-apart lateral edges, the distance between the two edges being such that when the lug is placed in the gap with the two lateral edges in contact with the two respective turns, the gap is sufficiently open to insert a key head.

4. A key ring comprising a ring having a complete first turn and a second turn joined to and resiliently pulled towards the first turn, which is separated from the second turn by a gap extending between the two turns and between the two free ends thereof, the head of a key being passed through the gap so as to fix it to or remove it from the key ring, wherein a lug is provided with a leading edge sufficiently thin to be inserted into the gap and sufficiently wide, by rotating the lug, to move the two turns apart sufficiently to insert a key head between them, wherein an auxiliary ring is provided to fixate the lug to the ring, said lug having an opening through which passes said auxiliary ring, the opening having a dimension in the direction parallel to the leading edge of the lug substantially equal to or greater than, the sum of the useful width of the leading edge and of the two thicknesses of the two turns in a direction perpendicular to the ring plane, the relative dimensions of the auxiliary ring, of the leading edge and of the opening of the lug being selected so that, when the lug is rotated of substantially 90 degrees, with the leading edge inserted on its width in the gap, the auxiliary ring is in contact with the lug so that the rotation of the lug is not possible in one direction of rotation, the lug being then retained between the two turns so that a user can insert a key between the two turns without having to hold the lug.

5. A key ring according to claim 1, wherein said lug is claw-shaped having a beveled leading edge.

6. A key ring according to claim 1, characterized in that the lug is of the same material as the ring or rings.

7. A key ring according to claim 1, characterized in that the component in the form of a lug comprises an enlarged key head bearing printed or engraved information.

8. A key ring according to claim 1, characterized in that the lug is of a substantially flat shape.

9. A key ring comprising a ring having a complete first turn and a second turn joined to and resiliently pulled towards the first turn, which is separated from the second turn by a gap extending between the two turns and between the two free ends thereof, the head of a key being passed through the gap so as to fix it to or remove it from the key ring, wherein a lug is provided with a leading edge sufficiently thin to be inserted into the gap and sufficiently wide, by rotating the lug, to move the two turns apart sufficiently to insert a key head between them, wherein an auxiliary ring is provided to fixate the lug to the ring, said lug having an opening through which passes said auxiliary ring, said two turns of the key ring are inserted in said auxiliary ring, wherein the relative dimensions of the auxiliary ring, of the leading edge and of the opening of the lug being selected so that, when the lug is rotated of substantially 90 degrees, with the leading edge inserted on its width in the gap, the auxiliary ring is in contact with the lug so that the rotation of the lug is not possible in one direction of rotation, the lug being then retained between the two turns so that a user can insert a key between the two turns without having to hold the lug.

* * * * *